United States Patent [19]

Bron

[11] 4,166,411

[45] Sep. 4, 1979

[54] FLUID-OPERATED LINEAR ACTUATOR

[76] Inventor: Dan Bron, 36, Hapalmach St., Romema, Haifa, Israel

[21] Appl. No.: 782,351

[22] Filed: Mar. 29, 1977

[30] Foreign Application Priority Data

Apr. 1, 1976 [IL] Israel ..... 49332

[51] Int. Cl.[2] ..... F01L 31/08; F01L 23/00

[52] U.S. Cl. ..... 91/337; 91/341 R; 91/346; 91/397; 91/398

[58] Field of Search ..... 91/398, 323, 397, 341 R, 91/341 A, 346, 342, 337; 137/624.27

[56] References Cited

U.S. PATENT DOCUMENTS

| | | | |
|---|---|---|---|
| 629,822 | 8/1899 | Shelburne | 91/341 R |
| 643,467 | 2/1900 | Watson | 91/341 R |
| 1,355,208 | 10/1920 | Bossler | 91/341 R |
| 1,470,684 | 10/1923 | Cade | 91/342 |
| 2,445,985 | 7/1948 | Weiner | 91/341 R |
| 2,804,055 | 8/1957 | Hill et al. | 91/337 |
| 2,985,147 | 5/1961 | Rockwell | 137/624.27 |
| 3,838,626 | 10/1974 | Carter | 91/398 |

*Primary Examiner*—Paul E. Maslousky

[57] ABSTRACT

A linear fluid-operated actuator includes a casing having a piston assembly slidingly movable in a main cylinder within the casing and provided with force transmitting means adapted to transmit the motion of the piston to the outside. A linear flow control assembly is provided including two valves which are each slidable within a valve cylinder positioned on either side of the main cylinder in coaxial relation and merging therewith. The valves are connected to each other for simultaneous movement and the size of the valve member, the extent of its movement and the position of an inlet and outlet port provided in each valve cylinder is such that the inlet in one cylinder is closed while its outlet is open, and the inlet of the other cylinder is open while its outlet is closed and communication between them is prevented. A retainer is provided for the valve assembly in either of its end positions and a spring is positioned between the piston and each valve. An abutment is positioned between the piston and each valve and is adapted to cause movement of the valves before the piston has reached the end of its stroke.

6 Claims, 4 Drawing Figures

FLUID-OPERATED LINEAR ACTUATOR

Figure 1:
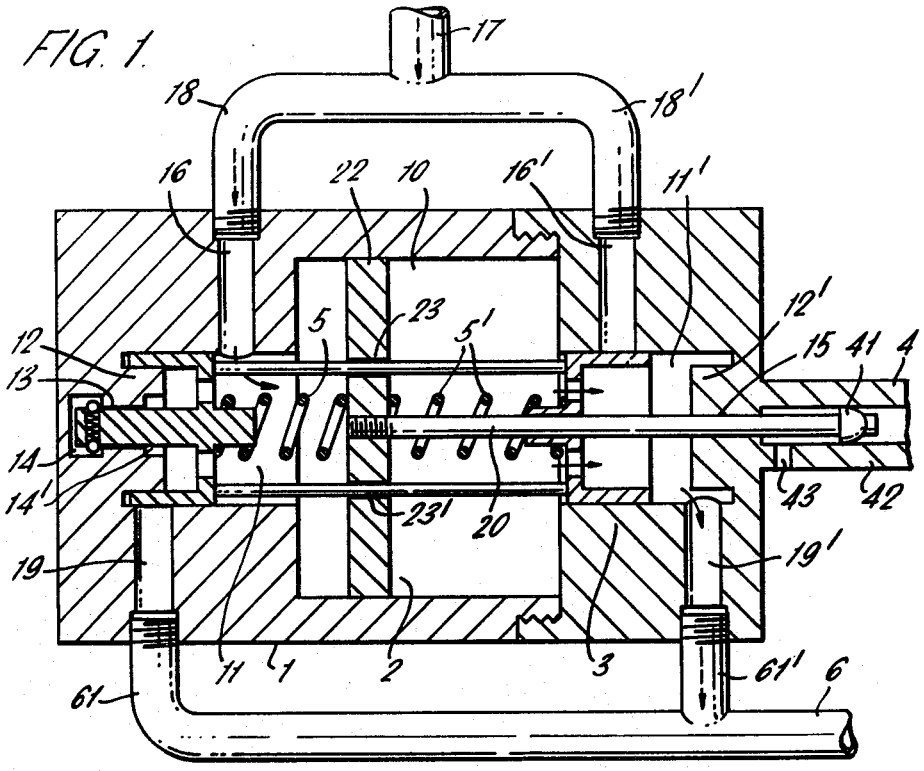

This invention relates to a fluid operated linear actuator for continuous reciprocating motion and in particular to a hydraulic linear actuator coupled to a piston pump.

Hydraulic and pneumatic actuators or motors serve to convert fluid pressure energy into mechanical energy and are primarily used in situations where the electric motors or internal combustion engines are not available. A preferred use of a hydraulic linear actuator coupled to a pump is as a proportioner for adding predetermined quantities of a concentrated liquid to water or other liquid used for irrigation, chemical processes or other industrial applications.

Various linear hydraulic and pneumatic motors and actuators have been designed in the past, most of these being equipped with flow control valves for steering the reciprocating motion, which rely on flip-action induced by sudden changes in water pressure. The drawback of these prior art structures is that their operation depends on a pressure drop across the hydraulic motor and that they are prone to stoppages and to a random positioning of the piston, upon failure or reduction of the water pressure. Their re-operation often requires manual setting, a feature which makes these appliances unsuitable for operation without constant supervision.

In addition, the existing apparatus are designed for entry and discharge of the fluid in duty cycles and not in a continuous flow, a fact that is liable to cause vibrations and to induce sudden pressure changes in the pipe system.

It is, therefore, an object of the present invention to provide a hydraulic actuator for continuous fluid flow with a minimum of flow obstruction and, accordingly, a negligible internal pressure loss. Another object is to provide an actuator with valves which will, under all conditions, return to their end position and will not fail to operate the actuator even after pressure failures.

The invention comprises a linear fluid-operated actuator including:

(a) a casing, (b) a piston assembly slidably movable in a main cylinder within the casing and provided with force transmitting means adapted to transmit the motion of the piston to the outside, (c) a linear flow control assembly comprising two valves each slidable within a valve cylinder provided on either side of the main cylinder in coaxial relation and merging therewith, the valves being connected to each other for simultaneous movement, and the size of the valve member, the extent of its movement and the position of an inlet and outlet port provided in each valve cylinder being such that the inlet in one cylinder is closed while its outlet is open, and the inlet of the other cylinder is open while its outlet is closed and communication between them is prevented, (d) retaining means for the valve assembly in either of its end positions, (e) spring means between the piston and each valve, and (f) abutment means between the piston and each valve adapted to cause movement of the valves before the piston has reached the end of its stroke.

Figure 2:
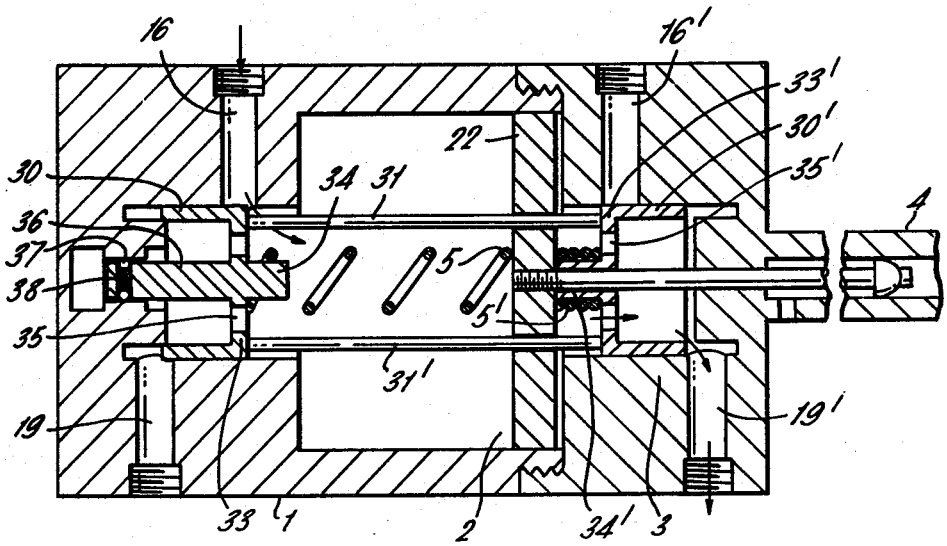
Figure 3:
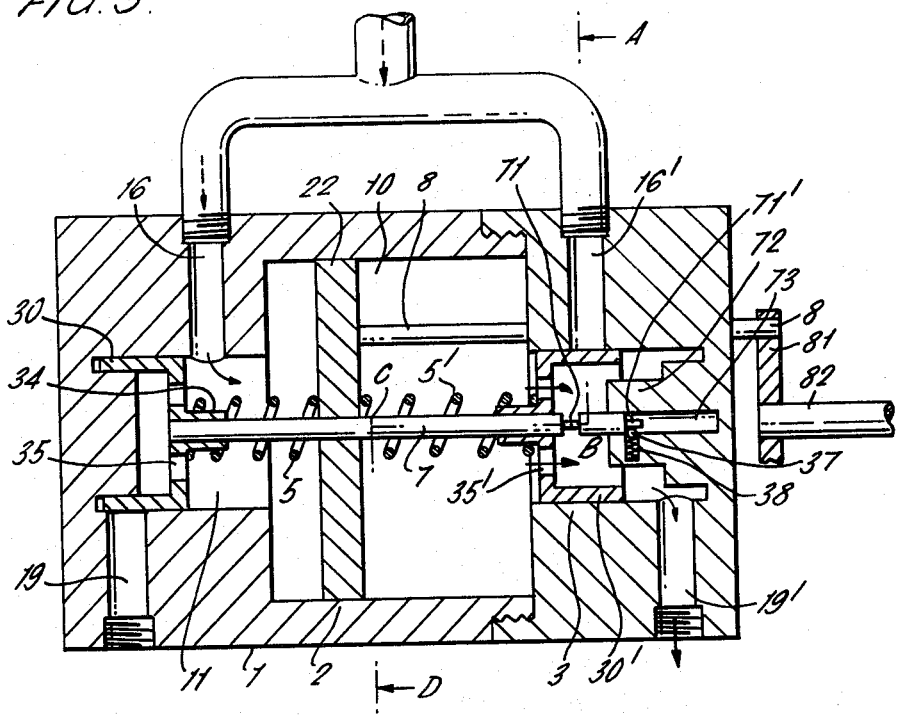
Figure 4:
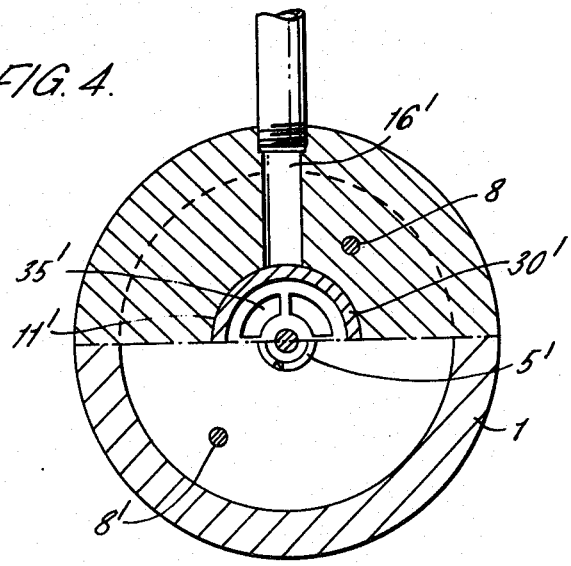

In the accompanying drawings which illustrate, by way of example, two embodiments of the invention, FIG. 1 is a longitudinal sectional view through a linear fluid-operated actuator comprising the present invention showing the flow control valve unit in an end position, FIG. 2 is a similar view of a section through the linear actuator of FIG. 1, showing the piston and the flow control valves after having been moved out of their end position, FIG. 3 is a longitudinal section through a modified linear actuator, and FIG. 4 is a cross section along A-B-C-D of FIG. 3.

It should be stated at the outset that the drawings show the embodiments of the invention in diagrammatic form only, the mechanical construction for assembly of the parts, e.g. by screwing, bolts or the like, not being indicated for the sake of clarity of the drawings. The same holds true for the sealing means which must be provided around the moving parts as is well known in the art.

With reference to FIGS. 1 and 2 of the drawings a linear actuator comprises a cylinder casing 1, a piston assembly 2, a flow control valve assembly 3 and two helical springs 5,5'. The drawing also shows a section through a piston pump 4 which, however, is not obligatory and may be replaced by any device adapted for reciprocating operation. The casing 1 contains, in its central portion, a main cylinder 10 of a relatively large diameter merging at either end with two coaxially symmetrical valve cylinders 11 and 11' of smaller diameter. Annular grooves are formed at the outer ends of the valve cylinders 11, 11' leaving cylindrical projections 12, 12' respectively. The left-hand cylindrical projection 12 is provided with an axial bore 13 which extends to short of the end wall of the casing and is enlarged at its outer and inner ends to form a first and second circumferential grooves 14 and 14', respectively.

The right-hand end wall of the casing is provided with a coaxial bore 15 for the sliding passage of a piston rod 20 fixed to a piston 22. The transfer of the work of the piston 22 to the outside of the casing is effected by the piston rod 20 which carries at its extreme end a leather cup 41 acting as a combined piston and valve and reciprocating in a partially shown pump cylinder 42. A liquid outlet 43 is provided in the pump cylinder adjacent the end wall of the casing 1.

Two inlet ports 16 and 16' into the valve cylinders 11, 11', respectively, are fed from a central supply pipe 17 through two branches 18 and 18', respectively, while two outlet ports 19 and 19' therefrom are provided in the annular groove between the projections 12, 12' and the cylinder walls. The outlets 19, 19' communicate with a pipe line 6 via two pipe branches 61 and 61', respectively.

The valve unit is further comprised of two sleeve valves 30 and 30' of equal diameter and length which are arranged for axially sliding movement in the said valve cylinders 11, 11', respectively, and are rigidly interconnected by at least two parallel bars 31, 31' which are adapted to pass slidingly through two corresponding holes 23, 23' provided in diametrically opposite positions in the piston 22. This permits independent axial movement of both the piston and the valve unit. Each valve is provided at its inner end which faces the piston 22 with a disc-shaped bottom 33, 33' and a cylindrical, axially extending boss 34, 34', respectively. Each sleeve valve is also provided with apertures 35, 35', which permit the passage of fluid from the main cylinder 10 to the outlet ports 19, 19'.

The right-hand sleeve valve 30 is integral with the boss 34' and has an axial aperture to permit the passage of the piston rod 20. The left-hand sleeve valve 30 is integral with the axially extending boss 34, which also forms a cylindrical shaft 36 in its outer end. The end of the shaft 36 has a diametrically extending bore which contains the valve-retaining mechanism comprised of two metal balls 37 and a slightly compressed, helical spring 38 therebetween.

Two identical helical springs 5 and 5' respectively, are positioned between the piston 22 and the end walls 33, 33' of the sleeve valves.

The actuator is operated by water or another fluid. In the position of the valve assembly shown in FIG. 1, water enters the left side of the main cylinder through the inlet port 16, the right-hand port 16' being closed by the sleeve valve 30'. Water pressure moves the piston to the right, and water from the previous operation is expelled by way of apertures 35 and port 19'. During the initial movement of the piston, the valve assembly is retained in its left-hand position by the said retaining mechanism 37, 38 in that spring 38 forces the two balls into the groove 14 at the end of the bore 13. However, the movement of the piston to the right compresses the helical springs 5' (see FIG. 2). The piston, because of the water pressure, continues on its way to the right until it contacts the boss 34' of the sleeve valve and exerts a force on the latter which is greater than that exerted by the helical spring, on the end wall of the sleeve valve 30'. This force now overcomes the predetermined strength of the spring 38 of the retaining mechanism which permits movement of the valve assembly. The valve assembly 3 starts to move to the right and forces the valve unit into its extreme position until the sleeve portion reaches the end of the valve cylinder 11'.

The retaining mechanism 37, 38 now engages the inner circumferential groove 14', preventing, for the time being, any movement of the valve assembly to the left.

During the passage of the sleeve valve 30' to the right its outer end starts to overlap the cylindrical projection 12' at the same moment as the inner end starts to uncover the inlet port 16'; simultaneously the one end of sleeve valve 30 is separated from contact with the cylindrical projection 13 while its other end starts to cover the inner port 16. FIG. 2 shows the valve assembly just before it reaches this position. The contact between the outer ends of the sleeve valves 30, 30' and the free ends of the cylindrical projections 12, 12', respectively, defines the actual moment of the closing of the one outlet port and the opening of the other. Simultaneously, the inlet port 16 is being covered by sleeve valve 30 and the inlet port 16' is uncovered by the sleeve valve 30', whereby the flow through the casing is reversed, i.e. water enters the cylinder 10 through the open port 16' and pushes the piston 22 to the left, causing the water to leave the left part of the cylinder through the opened outlet 19.

The length of the sleeves 30, 30' is designed so that their inner ends engage the cylindrical projections 12, 12' respectively, just before uncovering the corresponding inlet port 16, 16' in order to prevent water flowing directly from the inlet port to the outlet port on the same side of the casing. This is especially important when the actuator is to be used as proportioner for adding the liquid pumped by the pump 4 via outlet 43 to the water—or other liquid—passing through the actuator.

In FIGS. 3 and 4 another embodiment of the linear actuator is illustrated, the parts which are different from those of FIGS. 1 and 2 being described only. The two sleeve valves 30 and 30' are here connected to form a valve assembly by means of one axially extending connecting bar 7 which passes slidingly through the axis of the piston 22. This bar 7 is elongated to the right of the sleeve valve 30' and forms part of the retaining mechanism in that it is provided with an inner recess 71 in the form of a reduced diameter portion and an outer recess 71' in the form of a reduced diameter portion. These recesses are engaged alternately by a ball 37, pressed inwardly by a spring 38, both being housed in a radial bore provided in a boss 72 projecting inwardly from the end of the cylindrical projection 12'. In order to accommodate the elongated bar 7, a central bore 73 is provided in the casing.

The transmission of forces from the piston to the outside is effected by means of two bars 8 and 8' (FIG. 4) being rigidly connected with one end to the piston 22 and passing to the outside through suitably sealed holes (not shown). At their outer end they are connected by a yoke 81 which carries, in its center, a push bar 82 adapted to transfer the force to an oscillatingly movable device.

The operation of this embodiment is identical with that illustrated in FIGS. 1 and 2.

Only two embodiments of the invention have been illustrated and described above. These may be modified and altered by a person skilled in the art to suit various conditions. It is, for instance, possible to replace the two springs 5 and 5' by four smaller springs each mounted on the two ends of the connecting bars 31, 31'. Instead of two connecting bars, three or four bars at equal angular distribution may be used. The bosses 34 and 34' on the sleeve valves may be replaced by bosses attached to the center of the piston, or, in the case of the embodiment of FIG. 1, may be in the shape of loose bushings slidingly arranged on the bars 31, 31'. Instead of the retaining mechanism shown above, any other known mechanism of elastic retaining means may be employed, such as rollers, or the like.

In the embodiment illustrated in FIGS. 3 and 4, only one power transmission bar 8 may be attached to the piston, in off-center position; this arrangement is suitable for the transfer of smaller forces.

Furthermore, the projections 12, 12' may be eliminated, the force of the springs, the length of the valve cylinders, the location therein of the inlet and outlet ports and the length of the sleeve valve members being such that the working conditions above described are maintained. However, the bosses 34, 34' may be replaced by bosses or the like abutment members attached to both sides of the piston.

I claim:

1. A linear fluid-operated actuator comprising:

(a) a casing having a main cylinder and two axially spaced apart valve cylinders provided on opposite sides of said main cylinder in coaxial relation and in fluid communication therewith, each said valve cylinder including inlet and outlet means;

(b) piston assembly means comprising a piston head and an elongated piston rod slidingly movable in said main cylinder and provided with force transmitting means adapted to transmit the motion of said piston assembly means to the outside;

(c) a linear flow control assembly comprising two sleeve valves mounted in said casing concentrically with the longitudinal axis of said piston rod, each said sleeve valve having a transverse base wall and at least one aperture therethrough, each said sleeve valve being slidable within one of said valve cylinders, said sleeve valves being coaxially spaced from and rigidly connected to each other by at least two parallel rods loosely passing through said piston assembly means internally of said casing at said respective bore wall thereof for simultaneous movement, the size of each said sleeve valve, the extent of its movement and the position of said inlet means and outlet means provided in each said valve cylinder being such that said inlet means in one said valve cylinder is closed while its respective outlet means is open, and said inlet means of said other valve cylinder is open while its respective outlet means is closed and communication between them is prevented;

(d) spring-loaded retaining means adjacent only one of said sleeve valves and cooperating with a portion of said casing for temporarily preventing movement of said valve assembly from both of its end positions;

(e) spring means between said piston and each said sleeve valve; and (f) abutment means positioned between said piston head and said base wall of said sleeve valves, said abutment means being adapted to cause movement of said sleeve valves before said piston head has reached the end of its stroke.

2. An actuator as claimed in claim 1, wherein said piston assembly means is adapted to operate a pump piston.

3. An actuator as claimed in claim 1, wherein said rods extend axially and parallel to the axis of said piston assembly means.

4. An actuator as claimed in claim 1 wherein said abutment means between said piston head and said sleeve valves are mounted on said sleeve valves.

5. An actuator as claimed in claim 1 wherein said abutment means between said piston head and said sleeve valves are mounted on said piston assembly means.

6. An actuator as claimed in claim 1 wherein said retaining means comprise a spring housed in a bore in a part of one said sleeve valve with the axis of said spring being perpendicular to the axis of movement of said sleeve valve and two rollers, urged by said spring into either of two spaced depressions in said casing.

* * * * *